US006502362B1

(12) United States Patent
Zambelli et al.

(10) Patent No.: US 6,502,362 B1
(45) Date of Patent: Jan. 7, 2003

(54) ANCHORING DEVICE FOR COMPONENTS MADE OF CONCRETE

(76) Inventors: Sergio Zambelli, Via Stezzano 28, 24050 Zanica (IT); Benito Zambelli, Via Roma 44, 24050 Zanica (IT)

( * ) Notice: Subject to any disclaimer, the term of this patent is extended or adjusted under 35 U.S.C. 154(b) by 18 days.

(21) Appl. No.: 09/594,818

(22) Filed: Jun. 16, 2000

(51) Int. Cl.[7] ..... E04B 1/38

(52) U.S. Cl. ..... 52/698; 52/699; 52/700; 52/513; 52/378; 52/379; 52/561; 52/565; 52/701; 52/713; 52/383; 52/357; 52/562

(58) Field of Search ..... 52/698–700, 500.01, 52/513, 378, 379, 561, 565, 701, 713, 383, 357, 562

(56) References Cited

U.S. PATENT DOCUMENTS

| | | | | | |
|---|---|---|---|---|---|
| 4,060,951 | A | | 12/1977 | Sandor | |
| 4,955,172 | A | * | 9/1990 | Pierson | 52/379 |
| 5,207,043 | A | * | 5/1993 | McGee | 52/379 |
| 5,392,581 | A | * | 2/1995 | Hatzinikolas | 52/712 |
| 5,454,200 | A | * | 10/1995 | Hohmann | 51/513 |
| 5,490,366 | A | * | 2/1996 | Burns | 52/713 |

FOREIGN PATENT DOCUMENTS

| | | |
|---|---|---|
| DE | 29 16 003 | 10/1980 |
| DE | 197 25 882 | 12/1998 |
| GB | 2 047 375 | 11/1980 |

* cited by examiner

*Primary Examiner*—Carl D. Friedman
*Assistant Examiner*—Dennis L. Dorsey
(74) *Attorney, Agent, or Firm*—Guido Modiano; Albert Josif; Daniel O'Byrne

(57) ABSTRACT

An anchoring device for components made of concrete comprises an elongated section which is associable with a concrete component so as to protrude from the component with at least one of its longitudinal sides and with at least one portion of its lateral faces, which extend from the longitudinal side. Engagement regions are provided in this portion of the lateral faces of the section and form a plurality of possible engagement positions, mutually spaced along the longitudinal extension of the section, for a coupling element which is detachably associable with the portion of the section that protrudes from the component. The coupling element has at least one engagement region which forms a plurality of possible engagement positions, mutually spaced parallel to the longitudinal extension of the section, for an element for connecting the coupling element to another component or another element to be rigidly coupled to the component. The extension of the at least one engagement region for the connecting element in a direction which is parallel to the longitudinal extension of the section is at least equal to the maximum distance between two contiguous positions of possible engagement provided for the coupling element along the section.

22 Claims, 4 Drawing Sheets

ANCHORING DEVICE FOR COMPONENTS MADE OF CONCRETE

BACKGROUND OF THE INVENTION

The present invention relates to a highly versatile anchoring device for components made of concrete or the like.

The building method that uses prefabricated components entails the need to perform the on-site assembly of the components produced in the factory. This assembly can be of the wet type, performed for example by pouring additional concrete or by welding or chemical or mechanical anchoring, or of the dry type, performed by bolting.

In the field of dry assembly, which is the most advanced and currently most widely followed method, anchoring devices are known which use a basic component constituted by a section, commonly known as anchoring section, which is embedded in the concrete component during its production and is used to provide connection with other components by bolting.

Two different types of anchoring section are currently commercially available: C-shaped hollow sections, which are designed to be embedded substantially completely in the concrete component so that the open side of the C-shape is substantially co-planar to one face of the component, and sections which are again C-shaped and designed to be embedded substantially completely in the concrete so that the wing that connects the two arms of the C-shape is substantially co-planar with respect to a face of the component.

In the first case, the sections have a substantially C-shaped transverse cross-section with undercuts at the open side of the C-shape and are embedded substantially completely within the concrete component, so that the open side of the C-shape is arranged flush with one face of the component. In this manner, the open side of the C-shape forms an open channel with undercuts and the shaped head of a bolt is arranged inside the channel and is engaged, following a partial rotation of the bolt about its own axis, with the undercuts formed at the edges of the channel. The bolt is then used to connect the component in which the section is embedded to another component.

The head of the bolt can be arranged in any point of the extension of the channel, according to requirements, and therefore these anchoring devices allow "continuity of engagement" in the interconnection of the two components.

In the second case, the sections again have a substantially C-shaped transverse cross-section with two parallel wings joined by a connecting wing which is arranged at one face of the component. The two parallel wings are used to provide the stirrup arrangements for anchoring the section inside the component, and at least one slot is formed in the connecting wing and is elongated parallel to the longitudinal extension of the section; a bolt can engage the slot in order to connect the component to another component.

These devices, too, achieve "continuity of engagement" within the extension of the slot that is formed in the connecting wing of the section and runs along almost all the length of the section.

These conventional anchoring devices suffer drawbacks.

Owing to their particular structure, the anchoring sections of these devices in fact require the use of particular bolts which have a high cost.

Moreover, owing to the fact that these anchoring sections are meant to be embedded substantially completely inside the concrete component, they form, inside the component, a cavity which occupies space within the component and weakens it. Because of this, these sections are seldom usable in components which have a reduced thickness, in which the void formed by the anchoring section excessively compromises the resisting section of the component.

Another problem inherent in the use of these anchoring sections is that they require a depth for grip within the component in addition to the depth required to accommodate said anchoring section. In many cases, particularly in low-thickness components, the thickness of the component is insufficient to achieve adequate anchoring stirrup arrangements for these sections.

Moreover, when using these sections it is not always possible to achieve the possibility to adjust the connection between the two components in two mutually perpendicular directions, one of which is parallel to the longitudinal extension of the section.

Another problem inherent in the use of these conventional anchoring sections is the fact that during the embedding of the section inside the component it is necessary to arrange a sponge, or equivalent protective material, inside the section in order to prevent, during the production of the component, the concrete from entering the section, partially obstructing the cavity. This requirement makes it more complicated to produce the component.

Moreover, these sections require a predefined particular stirrup arrangement which cannot be changed according to the type of component with which said section must be used.

Another problem is the fact that the anchoring stirrup arrangements used with these sections, particularly in the case of sections in which the intermediate slot of the C-shape is slotted, must be adequately protected against oxidation, since a portion of these anchoring stirrup arrangements is constantly exposed to atmospheric agents inside the cavity of the section.

Other hand-made anchoring sections are also known which are simply constituted by perforated or slotted elements which are partially embedded in the concrete component but do not allow "continuity of engagement" in the connection between the two components.

SUMMARY OF THE INVENTION

The aim of the present invention is to solve the above-mentioned problems, by providing an anchoring device for components made of concrete or the like which does not penalize the resisting section of the component and allows "continuity of engagement" in the interconnection of two components.

Within the scope of this aim, an object of the present invention is to provide an anchoring device which does not necessarily require the use of bolts and nuts of a particular type.

Another object of the present invention is to provide an anchoring device which allows the greatest freedom in choosing the stirrup arrangement for anchoring within the component.

Another object of the present invention is to provide an anchoring device which is very safe in the interconnection of two components.

Another object of the present invention is to provide an anchoring device which does not require particular refinements in order to be embedded within a concrete component.

Another object of the present invention is to provide an anchoring device which allows to adjust the connection between two components in two mutually perpendicular directions.

These and other objects which will become better apparent hereinafter are achieved by an anchoring device for components made of concrete or the like, characterized in that it comprises an elongated section which is associable with a concrete component so as to protrude from said component with one of longitudinal sides thereof and with at least one portion of lateral faces thereof, which extend from said longitudinal side; engagement regions being provided on said portion of the lateral faces of the section and forming a plurality of possible engagement positions, mutually spaced along a longitudinal extension of the section, for a coupling element which is detachably associable with said portion of the section that protrudes from the component; said coupling element having at least one engagement region which forms a plurality of possible engagement positions, mutually spaced parallel to the longitudinal extension of the section, for an element for connecting said coupling element to another component or another element to be rigidly coupled to said component; the extension of said at least one engagement region for the connecting element in a direction which is parallel to the longitudinal extension of said section being at least equal to the maximum distance between two contiguous positions of possible engagement provided for said coupling element along said section.

BRIEF DESCRIPTION OF THE DRAWINGS

Further characteristics and advantages of the present invention will become better apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 1:
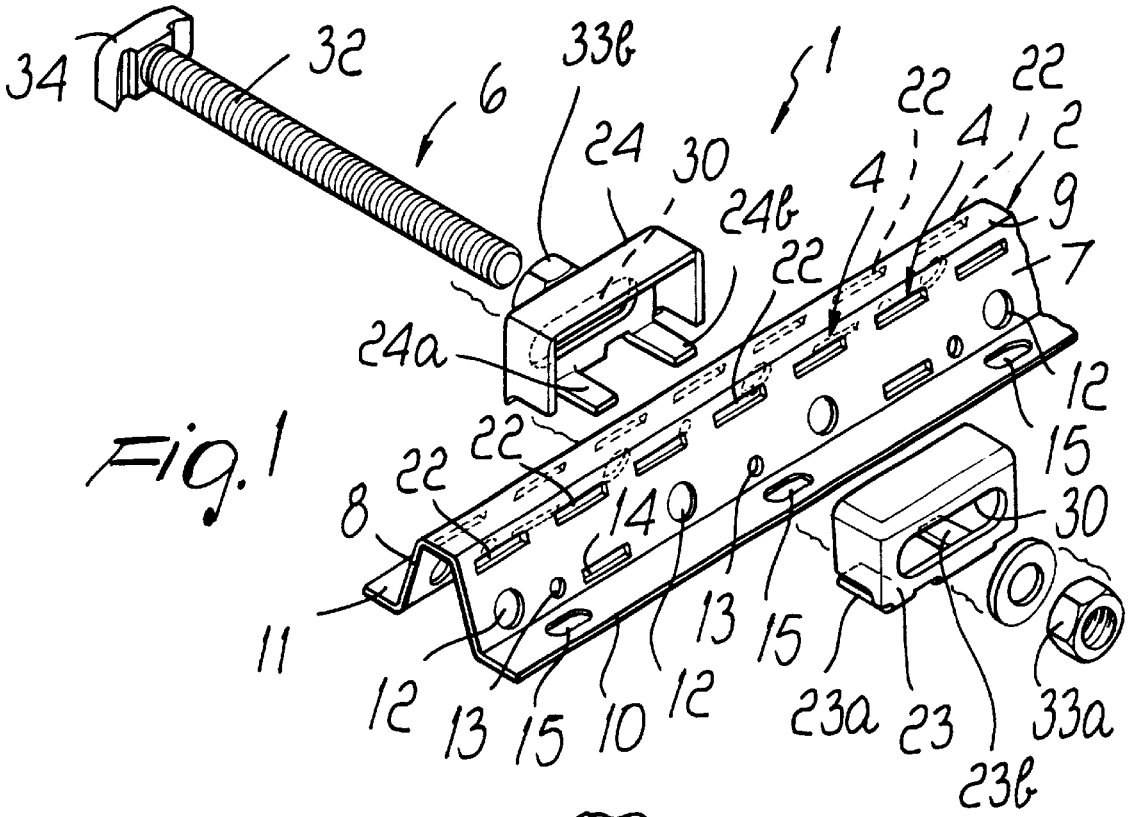
FIG. 1 is an exploded perspective view of the anchoring device according to the present invention.

With reference to the above figures, the anchoring device according to the present invention, generally designated by the reference numeral 1, comprises an elongated section 2 which is associable with a concrete component 3 so as to protrude from the component 3 with at least one of its longitudinal sides and with at least one portion of its lateral faces, which extend from said longitudinal side.

Engagement regions 4 are formed in this portion of the lateral faces of the section 2 and form a plurality of possible engagement positions which are mutually spaced along the longitudinal extension of the section 2 for a coupling element 5 which is detachably associable with the portion of the section 2 that protrudes from the component 3.

The coupling element 5 has at least one engagement region which forms a plurality of possible engagement positions, mutually spaced parallel to the longitudinal extension of the section 2, for a connecting element 6 which is adapted to connect the coupling element 5 to another component or other element to be rigidly coupled to the component 3. The extension, in a direction which is parallel to the longitudinal extension of the section 2, of the engagement region for the connecting element 6 provided on the coupling element 5 is at least equal to the maximum distance between two contiguous positions for possible engagement provided for the coupling element 5 along the section 2.

The section 2 can be produced by bending steel plate or can be made of aluminum and produced for example by extrusion, or can be made of synthetic material or of another material according to requirements.

Preferably, the section 2 has two lateral wings 7 and 8 which face each other and form the two lateral faces of the section on which the engagement regions 4 for the coupling element 5 are provided. The two lateral wings 7 and 8 are preferably mutually joined, at one of their sides, by a flat portion 9 which constitutes the longitudinal side of the section 2 that protrudes from the component 3 and from which the two lateral wings 7 and 8 protrude.

The lateral wings 7 and 8 preferably protrude along two inclined planes which converge toward the flat face 9.

The section 2 has an open transverse cross-section in which the open region is meant to be associated with the component 3 or embedded therein, as will become apparent hereinafter.

Preferably, in the two lateral wings 7 and 8, the edges 10 and 11 that are directed away from the flat face 9 are folded outward. The edges 10 and 11 are preferably substantially co-planar.

Although the section 2 can be directly associated with a face of a component by means of its edges 10 and 11 by using screw anchors or other conventional connection means, it is preferably meant to be partially embedded within the body of the component 3, proximate to one of its faces, so as to protrude from said face of the component 3 with a portion of its lateral wings 7 and 8 that lies proximate to the flat face 9. The engagement regions 4 for the coupling element 5 are formed in said portion of the lateral wings 7 and 8 that is meant to protrude from the face of the component 3.

Anchoring holes, designated by the reference numerals 12 to 15, are formed in the portion of the section 2 that is instead meant to be embedded within the body of the component 3; such holes can be used to rigidly couple the anchoring stirrups to the section 2.

Figure 5:
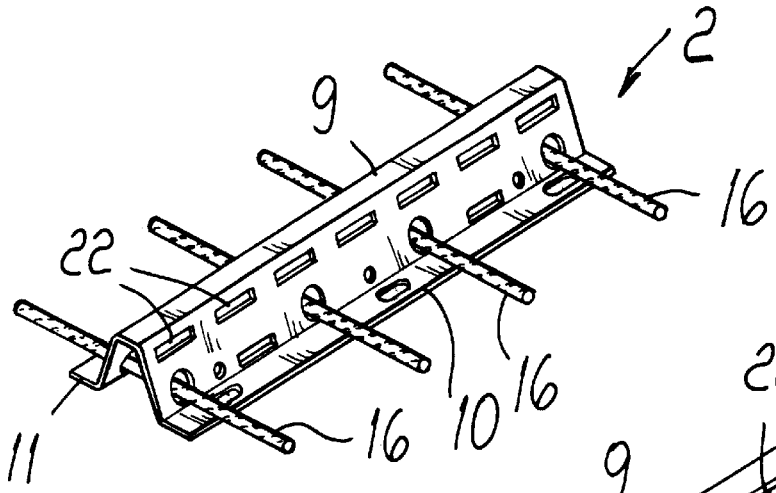
FIGS. 5 to 8 are perspective views of some of the possible anchoring stirrup arrangements for the section of the anchoring device according to the invention.

As shown in particular in FIG. 5, the anchoring stirrup arrangements can be simply constituted by straight transverse rods 16 which are inserted through the holes 12.

Figure 6:
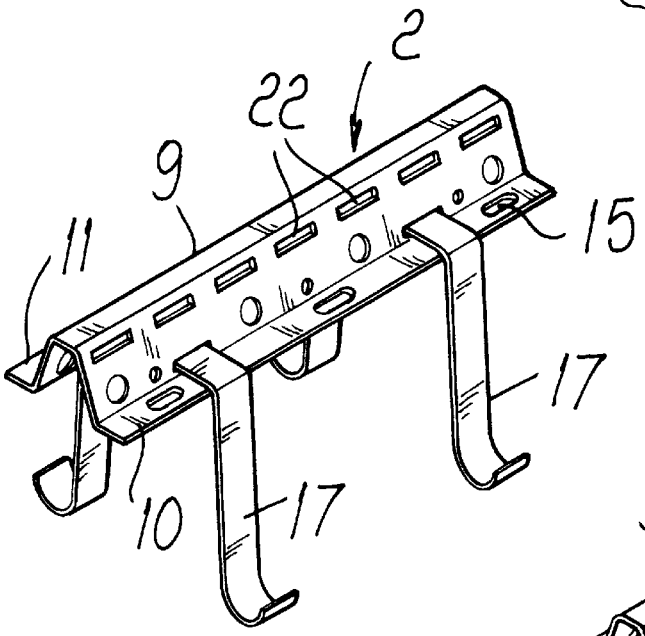

As shown in FIG. 6, the anchoring stirrup arrangements can also be constituted by appropriately shaped strips 17 which are inserted through the holes 14.

Figure 7:
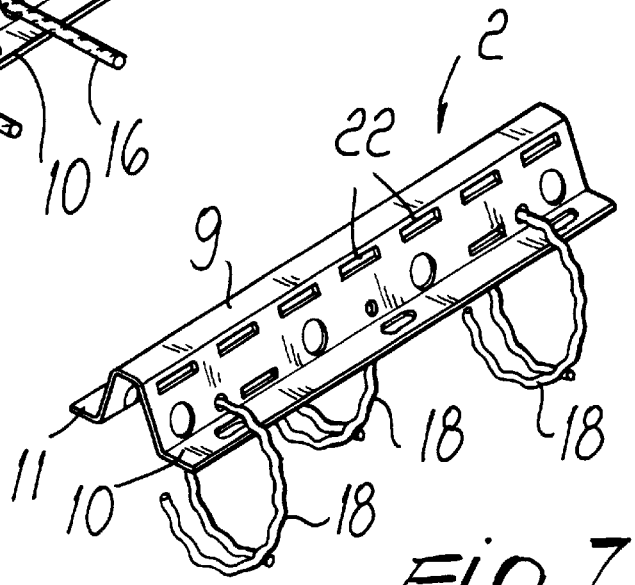

As shown in FIG. 7, the stirrup arrangements can be constituted by spirals 18 inserted through the holes 13.

Figure 8:
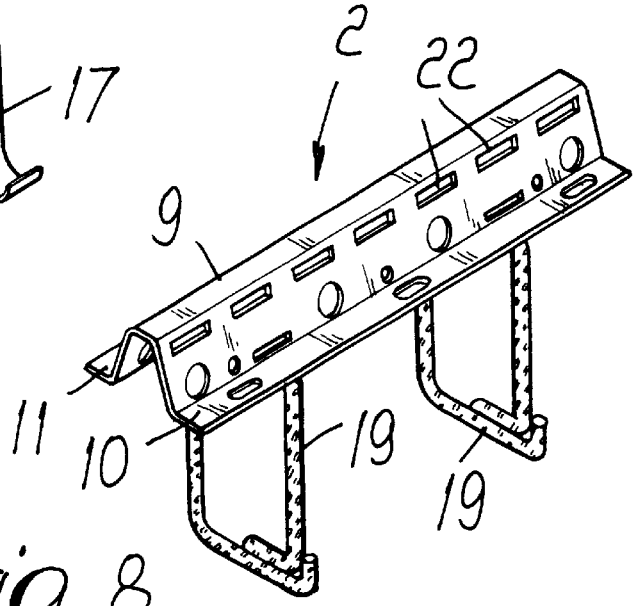

As shown in FIG. 8, the stirrup arrangements can also be constituted by stirrups 19 which are welded to the edges 10 and 11 of the lateral wings 7 and 8 of the section 2.

Instead of being used for the stirrup arrangements, the holes 15 formed in the edges 10 and 11 can be used to rigidly couple the section 2 to the component 3 by means of screw anchors.

Figure 3:
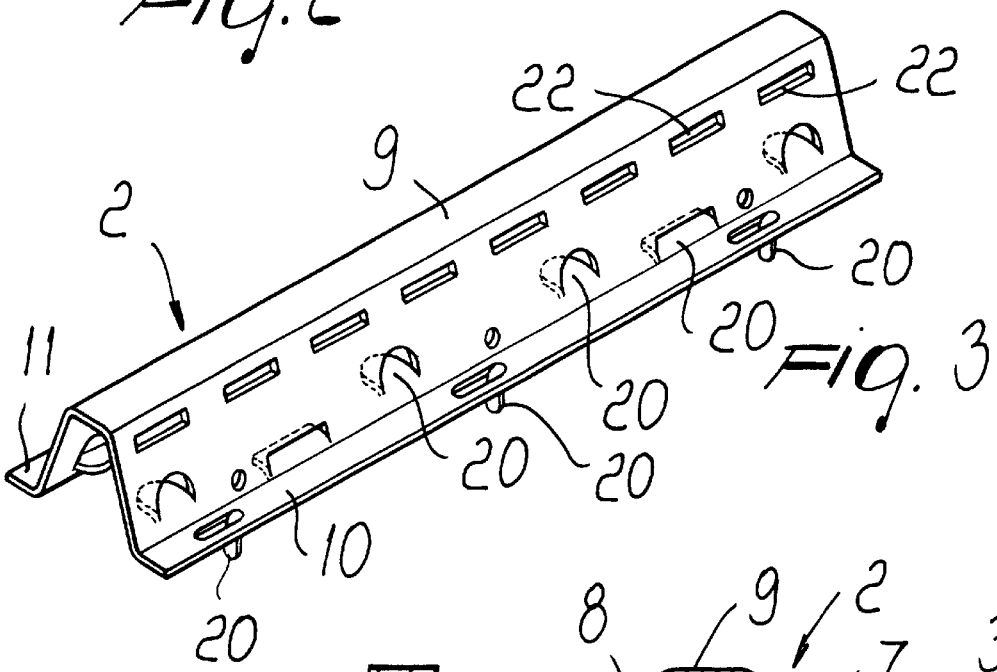
FIG. 3 is a perspective view of a different embodiment of the section of the anchoring device according to the invention.
Figure 4:
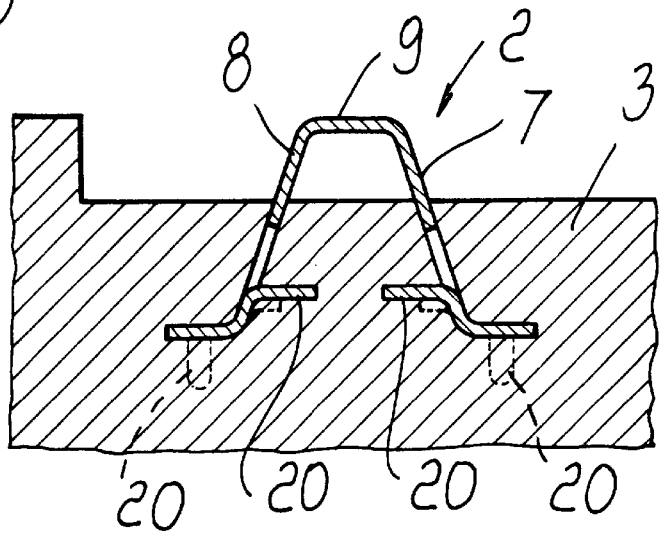
FIG. 4 is a sectional view of the section of FIG. 3, embedded in a concrete block.

As an alternative, and as shown in particular in the embodiment illustrated in FIGS. 3 and 4, the stirrup arrangements can be replaced or complemented by blanked and folded portions 20 so as to form lugs for anchoring in the component 3, at the portion of the section 2 that is meant to be embedded within the component 3.

The engagement regions 4, formed in the portion of the lateral wings 7 and 8 of the section 2 that protrudes from the component 3, comprise a plurality of coupling holes 22 which are preferably rectangular and are uniformly mutually spaced along the longitudinal extension of the section 2.

Conveniently, the holes 22 formed in the lateral wing 7 are aligned with the corresponding holes 22 formed in the other lateral wing 8 of the section 2.

The coupling element 5 comprises two half-shells 23 and 24 which can be mutually coupled so as to straddle the longitudinal side of the section constituted by the flat face 9, so as to protrude transversely with one of their portions from the flat face 9. The half-shells 23 and 24 are provided with engagement means which can be coupled to the engagement regions 4 formed in the portion of the two lateral faces of the section 2 that protrudes from the component 3. The two half-shells 23 and 24 preferably have a box-like structure which is obtained by blanking and bending metal plate.

More particularly, the half-shells 23 and 24 comprise a first half-shell 23 which has, along one of its sides, at least one tab which can be inserted at least inside the coupling holes 22 provided in the lateral face 7, and a second half-shell 24 which has, along one of its sides, at least one tab which can be inserted at least inside the coupling holes 22 provided in the other lateral face 8.

Preferably, the first half-shell 23 is provided with two feet 23*a* and 23*b* which can be coupled to two contiguous coupling holes 22 of the lateral wing 7, and said feet 23*a* and 23*b* have a length which is preferably such as to also engage within the coupling holes 22 formed in the other lateral face 8.

Likewise, the other half-shell 24 has two feet 24*a* and 24*b* which can be inserted in two contiguous coupling holes 22 of the other lateral wing 8, and their length is such as to also engage the coupling holes 22 formed in the lateral wing 7.

In practice, when the coupling element 5 is engaged with the section 2, its feet 23*a*, 23*b* and 24*a*, 24*b* occupy four coupling holes 22 which are mutually aligned in pairs and are formed in the two lateral wings 7 and 8. Each one of the coupling holes 22 is occupied by a tab 23*a* or 23*b* of the first half-shell 23 and by a tab 24*a* or 24*b* of the second half-shell 24 which are arranged side by side.

Conveniently, the first half-shell 23 is shaped so as to at least partially enter, with its portion that protrudes from the flat face 9 of the section 2, into the corresponding portion of the second half-shell 24.

Moreover the coupling element 5 is shaped so as to complementarily couple to the outer side of the portion of the section 2 that straddles the flat face 9 between the coupling holes 22 formed in the two lateral wings 7 and 8.

Once the coupling element 5 has engaged the section 2, it has a portion which protrudes transversely from the extension of the section 2 on the side of the flat face 9.

The engagement region for the connecting element 6 is formed on this portion of the coupling element 5, i.e., of the half-shells 23 and 24.

The engagement region is constituted by a slot 30 which passes through the portion of the half-shells 23 and 24 that protrudes from the flat face 9 of the section 2; said slot 30 is elongated in a direction which is parallel to the longitudinal extension of the section 2.

Conveniently, the extension of the region of the slot 30 that can be occupied by the connecting element 6 is greater than the center distance between the coupling holes 22 formed along the longitudinal extension of the section 2.

In this manner one achieves "continuity of engagement" of the connecting element 6 with respect to the section 2, i.e., it is possible to continuously vary the position of the connecting element 6 along the longitudinal extension of the section 2, as will become apparent hereinafter.

Figure 9:
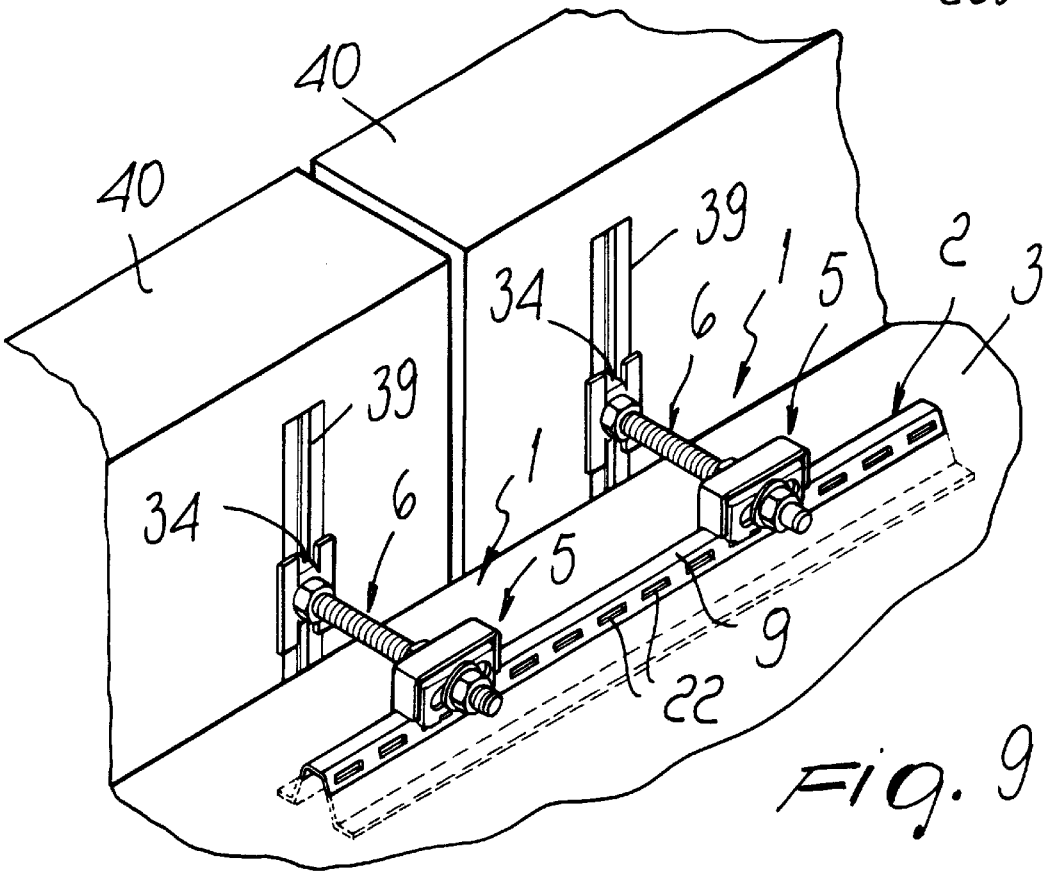
FIG. 9 is a perspective view of a connection between concrete components, provided by means of the anchoring device according to the invention.
Figure 2:
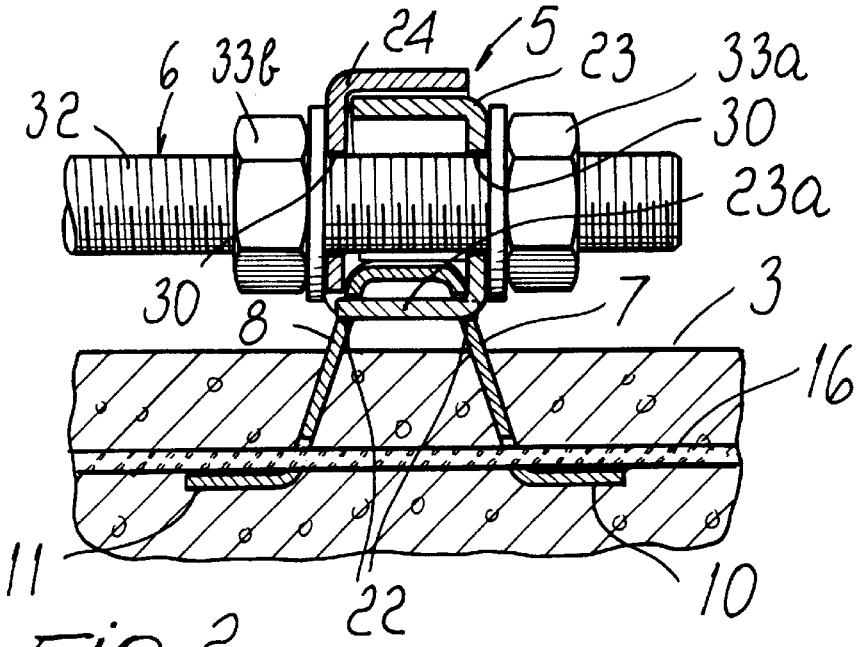
FIG. 2 is a transverse sectional view of the anchoring device according to the invention, applied to a concrete component.

The connecting element 6 can be constituted by a screw 32 provided with a threaded stem which is associable, by means of two nuts 33*a* and 33*b*, with the slot 30 formed in the half-shells 23 and 24 of the coupling element 5. The screw 32 can have, in a per se known manner, an appropriately shaped head 34 which can engage anchoring sections 39 of a known type which are embedded in the components 40 to be connected to the component 3, as shown in FIGS. 1 and 9.

Figure 10:
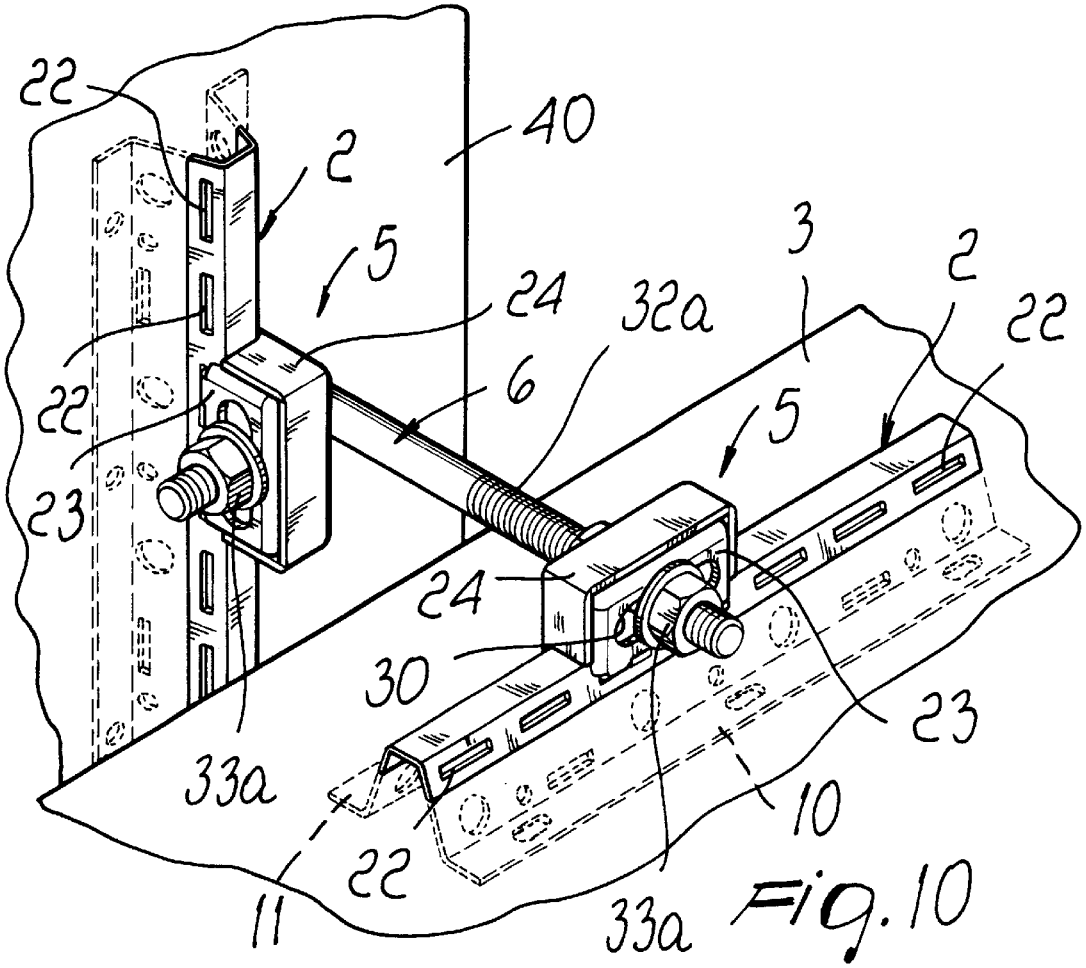
FIG. 10 is a perspective view of another connection between two concrete components, provided by means of the anchoring device according to the invention.
Figure 11:
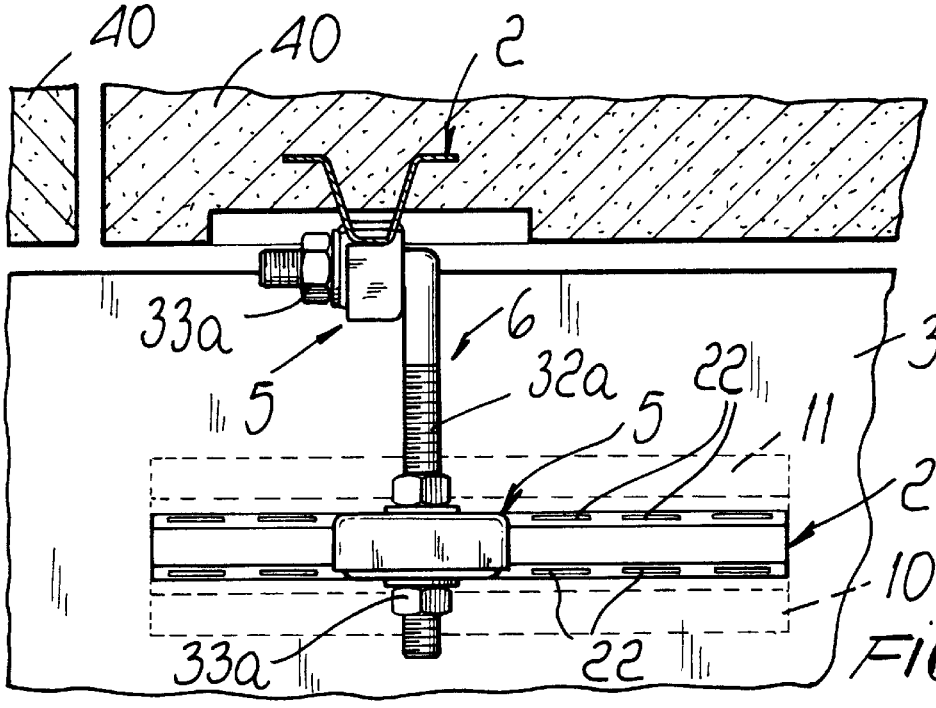
FIG. 11 is a top plan view of the connection of FIG. 10.

As an alternative, as shown in FIGS. 10 and 11, the connecting element 6 can be constituted by a threaded stem 32*a* which is folded at 90° and can engage, at its opposite ends, two coupling elements 5 of two anchoring devices according to the invention, in order to mutually connect two components 3 and 40 inside which a section 2 has been embedded as already described.

Alternatively, the connecting element can also be constituted by a hook, or by an element having another shape according to requirements, which is provided with a threaded portion which can engage, by means of the bolts 33*a* and 33*b*, the coupling element 5 in order to rigidly couple to the component 3 other elements, such as for example channels, cables, pipes or other accessory elements for buildings, instead of another component.

The use of the anchoring device according to the invention is as follows.

The prefabricated components 3 for which connection to other components or other elements of the building is required are formed beforehand by partially embedding a section 2 of preset length proximate to one of the faces of the component 3, so that the section 2 protrudes, with a portion of its lateral wings 7 and 8, proximate to the flat face 9, from one face of the component 3, optionally even at recessed regions formed in the face of the component so as to still allow the portion of the section that is provided with the coupling holes 22 to protrude from a region of the component 3 without necessarily protruding from the overall dimensions of the component 3, as shown in particular in FIG. 11.

Alternatively, the section 2 can be applied to a face of the component 3, for example by means of expanding screw anchors or other fixing systems.

Then, during the assembly of the component on site, the two half-shells 23 and 24 of the coupling element 5 are assembled to the portion of the section 2 that protrudes from the component by inserting the feet 23*a* and 23*b*, 24*a* and 24*b* in two contiguous coupling holes 22, or rather inside four coupling holes 22 which are mutually aligned in pairs, by way of a mutual approach of the two half-shells 23 and 24 in a direction which lies transversely to the longitudinal extension of the section 2.

It should be observed that the position of the half-shells 23 and 24 along the longitudinal extension of the section 2 can be changed according to requirements, since a plurality of coupling holes 22 are available which are uniformly mutually spaced along the longitudinal extension of the section 2.

The half-shells 23 and 24, coupled to the section 2, are then locked by means of the connecting element 6, which is bolted at the slot 30 by means of the nuts 33*a* and 33*b*.

Also in this case, the position of the threaded stem of the connecting element 6 inside the slot 30 can be changed according to requirements.

Owing to the fact that the extension, in a direction which is parallel to the longitudinal extension of the profile 2, of the regions of possible locking of the threaded stem of the connecting element 6 along the slot 30 is greater than the center distance between two coupling holes 22 which are contiguous, i.e., are arranged on a same lateral wing 7 or 8 of the section 2, it is possible to arrange the connecting element 6 in any point along the entire extension of the section 2.

Before locking the half-shells 23 and 24 on the section 2, or after the locking, the connecting element 6 is rigidly coupled to another component 40, as shown in FIGS. 9 to 11, or to other elements to be connected to the component 3.

It should also be noted that the axial position of the threaded stem 32, 32*a* of the connecting element 6, with respect to the coupling element 5, can be changed, thus also allowing to adjust the connection between the components in a direction which lies at right angles to the extension of the section 2.

If the section 2 does not have the blanked and folded portions 20, owing to its particular configuration it can also be stacked with other identical sections, thus achieving the advantage of occupying a small space during packaging and shipping.

In practice it has been observed that the anchoring device according to the invention fully achieves the intended aim and objects, since it does not reduce the resisting section of the component inside which it is embedded or with which it is associated, although allowing "continuity of engagement" in the connection between two components or between a component and other elements.

Another advantage of the anchoring device according to the invention is that it does not necessarily require the use of sponges or other elements to protect the cavity of the section during the production of the component.

Another advantage of the anchoring device according to the invention is that it leaves great freedom of choice as regards the anchoring stirrup arrangements inside the component and the greatest freedom of choice as regards the bolts and nuts for anchoring.

The device thus conceived is susceptible of numerous modifications and variations, all of which are within the scope of the inventive concept; all the details may furthermore be replaced with other technically equivalent elements.

In practice, the materials used, as well as the dimensions, may be any according to requirements and to the state of the art.

What is claimed is:

1. An anchoring device for components made of concrete, comprising an elongated section, having two longitudinal sides and lateral faces, to be connected with a concrete component so as to protrude from said component with one of said longitudinal sides and with at least one portion of said lateral faces, which extend from said longitudinal side; engagement regions being provided on said portion of the lateral faces of the section and forming a plurality of engagement positions, mutually spaced along a longitudinal extension of the section, parallel to the section, for a coupling element which is detachably connected with said portion of the section that protrudes from the component; said coupling element having at least one engagement region which forms a plurality of possible engagement positions, mutually spaced parallel to the longitudinal extension of the section, for an element for connecting said coupling element to another component or another element to be rigidly coupled to said component; the extension of said at least one engagement region for the connecting element in a direction which is parallel to the longitudinal extension of said section being at least equal to the maximum distance between two contiguous positions of engagement provided for said coupling element along said section.

2. The device according to claim 1, wherein said section has two lateral wings which face each other and form said lateral faces, said two lateral wings being mutually joined at one of sides thereof, said side constituting said longitudinal side of the section.

3. The device according to claim 2, wherein said two lateral wings lie on two inclined planes which converge toward said longitudinal side of the section.

4. The device according to claim 3, wherein said two lateral wings are joined, at said longitudinal side of the section, by a flat face.

5. The device according to claim 1, wherein said section has an open transverse cross-section, in which the open region is adapted to be connected to, or embedded in, said component.

6. The device according to claim 2, wherein said two lateral wings have edges that are directed away from said longitudinal side of the section, said edges being folded outward.

7. The device according to claim 6, wherein said edges of the two lateral wings that are folded outward are substantially co-planar.

8. The device according to claim 1, wherein said section has, in a portion thereof that is to be embedded in said component, anchoring holes which can be engaged by anchoring stirrup arrangements.

9. The device according to claim 1, wherein said section has, on a portion thereof to be embedded in said component, portions which are blanked and folded so as to form lugs for anchoring in the component.

10. The device according to claim 2, wherein said engagement regions formed in a portion of said two lateral faces of the section that protrudes from the component comprise a plurality of coupling holes which are formed in said two lateral wings and are uniformly spaced from each other along the longitudinal extension of the section.

11. The device according to claim 10, wherein said coupling element comprises two half-shells which can be mutually coupled so as to straddle said longitudinal side of the section; said half-shells being provided with engagement means which can be coupled to said engagement regions formed in the portion of said two lateral faces of the section that protrudes from the component; said at least one engagement region for said connecting element being formed on a portion of said half-shells that protrudes transversely from said longitudinal side of the component.

12. The device according to claim 11, wherein said two half-shells comprise a first half-shell which has, along one of its sides, at least one tab which can be coupled to one of said coupling holes formed in at least one of said two lateral wings, and a second half-shell which has, along one of its sides, at least one tab which can couple to one of said coupling holes formed at least in the other one of said two lateral wings; said half-shells being mutually associable by mutual approach in a direction which lies transversely to the longitudinal extension of said section; said half-shells being engaged with said section protruding, with a portion which lies opposite the side provided with said at least one tab, from said longitudinal side of the section.

13. The device according to claim 1, wherein said at least one engagement region of the coupling element comprises a slot which is elongated parallel to the longitudinal extension of said section.

14. The device according to claim 13, wherein said slot passes through said portion of said half-shells that protrudes transversely from said longitudinal side of the section.

15. The device according to claim 11, wherein one of said half-shells can be at least partially inserted, with its portion that protrudes transversely from said longitudinal side of the section, in the portion that protrudes transversely from said longitudinal side of the section of the other half-shell.

16. The device according to claim 10, wherein the coupling holes formed in one of said two lateral wings of the section are aligned with the coupling holes formed in the other one of said two lateral wings.

17. The device according to claim 10, wherein each one of said half-shells has two tabs which can be inserted in two contiguous coupling holes formed in one of the two lateral wings of the section.

18. The device according to claim 12, wherein each tab of said half-shells has such a length as to simultaneously engage a coupling hole formed in one of said two lateral wings and the coupling hole which is aligned with said first coupling hole and is formed on the other one of said two lateral wings.

19. The device according to claim 18, wherein each tab of one of the half-shells engages the same coupling holes engaged by a tab of the other half-shell inside a same coupling hole.

20. The device according to claim 11, wherein said half-shells have a configuration which couples to an outer profile of said section in a region thereof that straddles said longitudinal side of the section.

21. The device according to claim 11, wherein said connecting element has a threaded stem which can be inserted through said slot of the coupling element and is provided with two nuts for mutually clamping said half-shells whose tabs engage in said coupling holes.

22. The device according to claim 11, wherein said half-shells have a box-like shape provided by means of blanked and folded metal plate.

* * * * *